United States Patent [19]

Henson

[11] Patent Number: 5,058,236

[45] Date of Patent: Oct. 22, 1991

[54] ADJUSTABLE HINGE

[76] Inventor: Ormel W. Henson, 1310 Walea St., Jasper, Tex. 75951

[21] Appl. No.: 475,918

[22] Filed: Feb. 6, 1990

[51] Int. Cl.[5] ..... E05D 7/04; E05D 5/00

[52] U.S. Cl. ..... 16/222; 16/238; 16/245; 16/248; 16/380; 16/386; 16/387

[58] Field of Search ..... 16/229, 237, 238, 243-245, 16/248, 380, 381, 386, 222, 387, DIG. 13

[56] References Cited

U.S. PATENT DOCUMENTS

| | | | |
|---|---|---|---|
| 442,547 | 12/1890 | Radler . | |
| 843,081 | 2/1907 | Fitzgerald . | |
| 1,103,607 | 7/1914 | Moore | 16/244 |
| 2,373,955 | 4/1945 | Fuller . | |
| 2,588,258 | 3/1952 | Lowman | 16/243 |
| 3,007,199 | 11/1961 | Hughes . | |
| 4,381,580 | 5/1983 | Helstrom et al. . | |

FOREIGN PATENT DOCUMENTS

| | | | |
|---|---|---|---|
| 812652 | 9/1951 | Fed. Rep. of Germany | 16/244 |
| 1029728 | 6/1953 | France | 16/243 |
| 211865 | 7/1984 | United Kingdom | 16/248 |

*Primary Examiner*—Richard K. Seidel
*Assistant Examiner*—Edward A. Brown

[57] ABSTRACT

A hinge for making a controlled adjustment on a door or the like to facilitate upward or downward movement as desired due to the binding of the door or the like. The hinge can be of many shapes and dimensions to accommodate the application involved. The adjusting screws can be of various sizes according to the size of the hinge made and to fit in the top and bottom of the hinge.

Stop pins are inserted at 90 degree angles through the hinge pin for the purpose of making the hinge pin stationary in reference to the hinge so that the hinge will move up or down with the rotation of the adjusting screws on the ends of the joining pin.

1 Claim, 1 Drawing Sheet

ADJUSTABLE HINGE

BACKGROUND OF THE INVENTION

1. Field of Invention

This invention relates to hinges, especially to hinges that can be adjusted, without removal, to raise or lower a door that is binding or otherwise dragging at the top or bottom and to correct a misalignment of the door lock if needed.

2. Description of the Prior Art

Most, if not all consumers, have installed a hinge that is fixed in its construction which could be described basically as two pieces of metal joined on one side by a pin that allows each to rotate back and forth on the pin.

There are a wide variety of hinges of this sort for dwelling doors, cabinet doors, gates of all kinds, etc., but few allow for an adjustment in the up or down movement without removing the hinge and resetting to the desired level. The following U.S. Pat. Nos. represent the prior art hinges: 442,557; 843,081; 2,373,955; 2,588,258; 3,007,193 and 4,381,580. No adjustable hinges were found that could be universally be used on homes except the present invention. That is to say that the above mentioned patents will only work 50% of the time, either on a left hand door or a right hand door. This being the case, they cannot be interchanged. Whereas the present invention would provide a hinge that could be used in any configuration because it has no top or bottom and would require no significant instructions for installation. This hinge has no unsightly knob or protrusion extending above or below the center pin which makes it more acceptable in today's modern construction plans. This hinge has a minimal number of parts for cost of production. The end result being a retail price that would be acceptable to potential customers. The misalignment of a door causes great inconvenience in that it takes great effort to shut, and wont stay shut because the locking mechanism is out of line with the receptacle. The door must be removed, the hinges must be reset, or the top or bottom of said door must be trimmed off, or both, to realign.

Most users, therefore, would find it desirable to have an adjustable hinge that would raise or lower the said door without trimming the door or removing the hinge and could be done in a relatively short period of time.

SUMMARY

Accordingly, the following are objects and advantages of the invention: to provide a hinge for easily, reliably, and neatly adjusting a door without the inconvenience of having to remove the door to do so. To provide a hinge that can be adjusted with a minimum of effort and skill. To provide a hinge that can be used on any door whether it opens from the right or left. This hinge has perforations on the back side so as not to deter from cosmetic appearance. When broken away with pliers, rounded corners would result which would be mandatory for it to fit all applications. The adjusting screws on the top and bottom of the hinge would be fitted with Allen wrench sockets to give more leverage when adjusting as opposed to a screwdriver.

Readers will find further objects and advantages of the invention from a consideration of the ensuing description and accompanying drawings.

Figure 2:
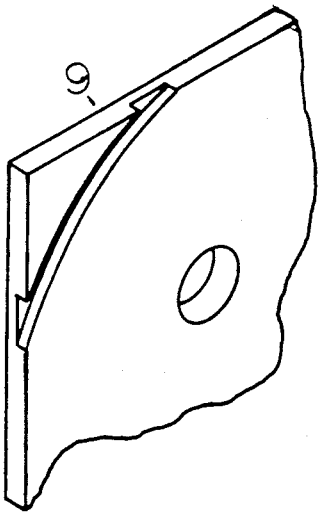
FIGS. 2 and 3 illustrate perspective views of a double screw adjustable hinge.
Figure 1:
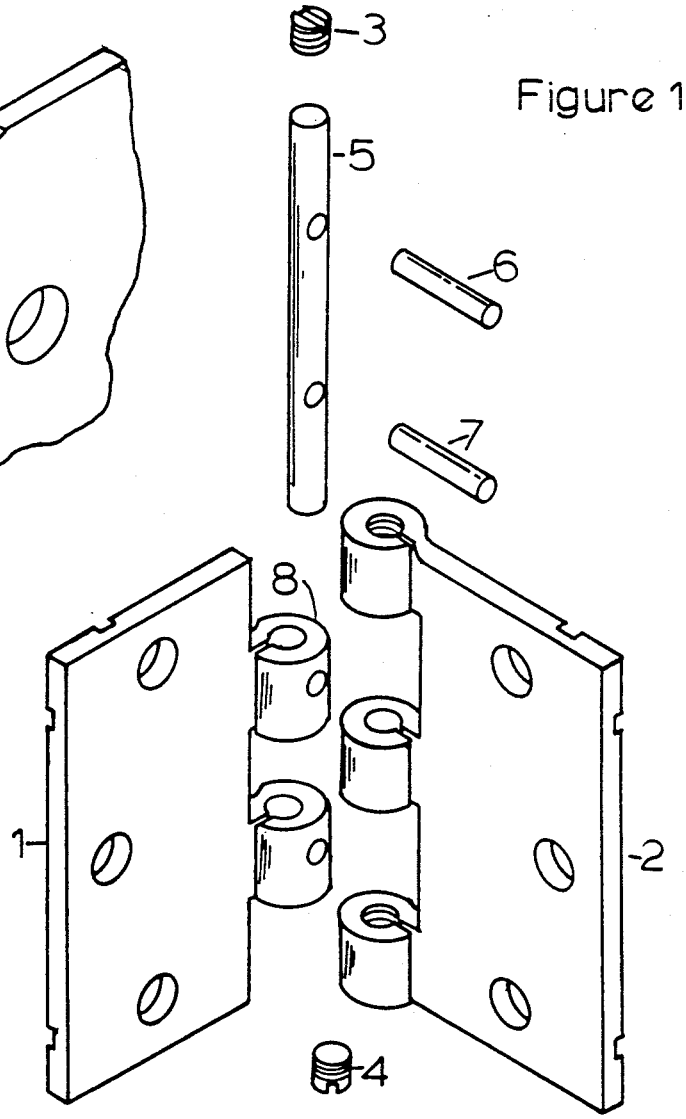
FIG. 1 illustrates a front view of a double screw adjustable hinge.
Figure 3:
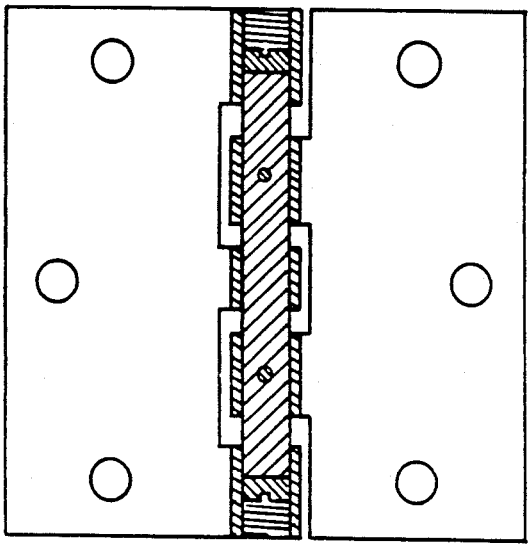

The present hinge illustrated in FIGS. 1–3 comprises first half 1 and second half 2, each having receptacles 8 for receiving a hinge pin 5, adjusting screws 3 and 4, and stop pins 6 and 7.

It will perform the function of raising or lowering a door that is in a approximate perpendicular position depending on which way it needs to be adjusted. For instance, if the door needs to be adjusted upward the top adjusting screw 3 is turned in a counterclockwise direction with a corresponding turning in a clockwise direction of the bottom adjusting screw 4. To adjust the door downward a reversal of the directions is required. The adjusting screws 3 and 4 rest on the connecting pin 5 that goes through both sides of the hinge and the connecting pin 5 is short enough to allow space for the adjusting screws 3 and 4 to be threaded and installed in each end of the hinge. The stop pins 6 and 7 each pass through a receptacle 8 and the hinge pin 5 for controlling the movement of the hinge pin in the receptacles.

While I have described the function of the hinge in FIG. 1, in actual practice it can be accomplished in a relatively short period of time as compared to the process of removing the door, trimming the top or bottom and reinstalling to accomplish the same result.

While the description contains some specificities, the reader should not construe these as limitations on the scope of the invention, but merely as exemplification of a preferred embodiment thereof. Those skilled in the art will envision many other possible variations are within its scope. For example, skilled artisans will readily be able to change the dimensions and shapes of the various embodiments. It is also possible to make the hinge of different materials such as plastics rather than metal. The corners could have a perforation 9 that is rounded so that the square corner could be removed if a rounded corner is preferred. See FIG. 2. Possibly there could be a variation on the adjustment mechanism of FIG. 1. Accordingly the reader is requested to determine the scope of the invention by the appended claims and their legal equivalents.

We claim:

1. A hinge for performing a controlled adjustment of a door or the like, comprising:

a hinge pin;

a first half having one or more holes therethrough for mounting to said door or the like and a first plurality of receptacles for receiving said hinge pin;

a second half having one or more holes therethrough for mounting to said door or the like and a second plurality of receptacles for receiving said hinge pin;

an adjusting screw received in one of said second plurality of receptacles at an end of said hinge;

another adjusting screw received in another of said second plurality of receptacles at an opposite end of said hinge;

the hinge being adjustable by rotating the adjusting screws in opposite directions;

a plurality of stop pin means, each stop pin means passing through both said hinge pin and a first receptacle at a 90 degree angle relative thereto for preventing movement of said hinge pin relative to said first hinge leaf and also to said first and second plurality of receptacles in the length dimension of said hinge pin;

said first and second halves each having at least one substantially square corner with rounded perforation means for allowing each said corner to form an arcuate shape.

* * * * *